US005251563A

United States Patent [19]

Staehs et al.

[11] Patent Number: 5,251,563

[45] Date of Patent: Oct. 12, 1993

[54] SYNCHRONOUS DRIVE AND BRAKING MEANS FOR MATERIAL HANDLING CAR

[75] Inventors: Joel L. Staehs, DeSoto; Gene DiFonso, Arlington; William C. Bortzfield, deceased, late of Grand Prairie, all of Tex., by Beverly J. Bortzfield, executrix

[73] Assignee: BAE Automated Systems, Inc., Carrollton, Tex.

[21] Appl. No.: 967,667

[22] Filed: Oct. 28, 1992

[51] Int. Cl.[5] ..... B61B 13/00

[52] U.S. Cl. ..... 104/168

[58] Field of Search ..... 104/168, 163, 162, 165, 104/170, 171

[56] References Cited

U.S. PATENT DOCUMENTS

| | | | |
|---|---|---|---|
| 147,876 | 2/1874 | Speer | 104/168 |
| 3,114,332 | 12/1963 | Bacon et al. | 104/168 |
| 3,361,083 | 1/1968 | Babson | 104/168 |
| 3,530,800 | 9/1970 | Watkins et al. | 104/168 |
| 3,610,391 | 10/1971 | Beck | 198/1 |
| 3,818,838 | 6/1974 | Morton | 104/168 |
| 4,503,778 | 3/1985 | Wilson | 104/28 |
| 4,530,287 | 7/1985 | Sticht | 104/168 |
| 4,564,100 | 1/1986 | Moon | 198/341 |
| 4,656,949 | 4/1987 | Ragot | 104/172.3 |
| 4,671,186 | 6/1987 | Kunczynski | 104/168 |
| 4,793,262 | 12/1988 | Horn | 104/168 |
| 4,867,069 | 9/1989 | Kunczynski | 104/168 |

FOREIGN PATENT DOCUMENTS

| | | | |
|---|---|---|---|
| 2595310 | 9/1987 | France | 104/168 |
| 0224864 | 10/1991 | Japan | 104/168 |
| 0617612 | 7/1978 | U.S.S.R. | 104/168 |
| 1609729 | 11/1990 | U.S.S.R. | 104/168 |

*Primary Examiner*—Mark T. Le

*Attorney, Agent, or Firm*—Lorusso & Loud

[57] ABSTRACT

A material handling car and track assembly is presented. The assembly comprises a car having a chassis portion, travel wheels mounted on the chassis portion, and a track having two parallel rails, the travel wheels being adapted to roll on the rails to facilitate movement of the car along the track. Frame portions depend from an underside of the chassis portion, the frame portions comprising first and second frame walls spaced from each other. First and second spindles are mounted between the rails, and contact wheels mounted on the spindles, the contact wheels being in a plane normal to the spindles. Bands are on the peripheries of the contact wheels for engaging the frame walls, the contact wheels being operative to modify the speed of the car in accordance with the selected rotational speed of the contact wheels.

30 Claims, 5 Drawing Sheets

SYNCHRONOUS DRIVE AND BRAKING MEANS FOR MATERIAL HANDLING CAR

BACKGROUND OF THE INVENTION b 1. Field of the Invention

This invention relates generally to a material handling car and track assembly and is directed more particularly to a synchronous drive and braking means mounted in the track assembly and adapted to influence the speed of the car.

2. Description of the Prior Art

It is generally known in car and track systems to propel and control the speed of a plurality of cars on tracks by means of wheels, the wheels being adapted to engage the cars in order to accelerate or decelerate the cars.

U.S. Pat. No. 4,656,949, issued Apr. 14, 1987 to Ragot, discloses a device for gripping and transferring a receptacle using synchronous endless chains with drive fingers mounted on adjustable modules, the drive fingers engaging a handle on the receptacle and pulling the receptacle along.

U.S. Pat. No. 4,564,100, issued Jan. 14, 1986 to Moon, discloses a device for conveying a plurality of carriers over a path for work to be performed on the articles supported by the carriers in successive work stations, comprising vertical drive wheels which engage the underside of the carrier and accelerate or decelerate the car. The car rides on the drive wheels. Guide rollers are provided for engagement with the sides of the carriers to guide the carriers laterally. Swivel wheels are provided to prevent the carrier's casters from contacting the drive wheels. The carriers are towed by dogs on a main conveyor movable along the floor. Moon discloses sensing means which provide for advancing the carrier to a next work station.

U.S. Pat. No. 4,503,778, issued Mar. 12, 1985 to Wilson, discloses a device for the transportation of people, comprising three track rails upon which trolleys ride, the trolleys including three wheels which interlock with the rails, a driving and braking means comprising a pair of horizontal driving and braking wheels which are adapted to engage opposite sides of a single vertically extending keel depending from the bottom of a carrier.

U.S. Pat. No. 4,530,287, issued Jul. 23, 1985 to Sticht, discloses a device for transporting workpieces in an assembly line, comprising guide means including two guide tracks, with one guide track having two hardened guide rollers mounted on the underside of a pallet and adapted to engage the the lateral guide track. Sticht also discloses advancing means comprised of elastic conveyor rollers above the track which advance the pallets along the tracks by means of a drive chain. The lateral guidance of the pallet is effected solely by one lateral guide track in engagement with its corresponding guide rollers, in cooperation with the conveyor rollers.

U.S. Pat. No. 3,361,083, issued Jan. 2, 1968 to Babson, discloses a device for carrying articles between work stations, comprising drive means which comprises center drive wheels, a sprocket disposed within the center drive wheel adapted to engage a drive chain which extends the length of a housing, and rack drive wheels mounted on axles above and below the center drive wheels, the lower end of one axle mounted on a link bar and the upper end connected to a pivot arm extending from a shaft of the center drive wheel, with a link bar enabling the rack drive wheels to be pivoted about the axes of the central drive wheels.

SUMMARY OF THE INVENTION

An object of the present invention is to provide a car and track assembly with an improved driving and braking means to be used in conjunction with the track assembly.

Another object of the present invention is to provide a car and track assembly in which a driving and braking means is provided for maintaining a precise and selected speed of the car.

A further object of the present invention is to provide a car and track assembly in which a driving and braking means is provided for effortlessly and efficiently transporting the car up and down sharp inclines.

A still further object of the present invention is to provide a track assembly in which a series of cars are driven by a single motor.

Yet another object of the present invention is to provide a track assembly having a series of two adjacent contact wheels, and a car having a chassis portion with downwardly extending frame means, each contact wheel engaging a corresponding downwardly extending frame means.

Still another object of the present invention is to provide a car and track assembly in which synchronous means is provided for controlling the speed and location of cars in conjunction with a conveyor means, such that material from a conveyor means is loaded and unloaded onto a moving car.

Yet a further object of the present invention is to provide a car and track assembly in which sensing means is operative to start rotational movement of wheels which engage the car assembly.

Still a further object of the present invention is to provide a car and track assembly in which sensing means is operative to instruct a car to merge into a track assembly in which numerous other cars are traveling.

A still further object of the present invention is to identify the location of a package of material by identifying its corresponding carrier.

With the above and other objects in view, as will hereinafter appear, a feature of the present invention is the provision of a material handling car and track assembly, the assembly comprising a car having a chassis portion, travel wheels mounted on the chassis portion, and a track having two parallel rails, the travel wheels being adapted to roll on the rails to facilitate movement of the car along the track, frame means depending from an underside of the chassis portion, the frame means comprising first and second frame members spaced from each other, first and second spindles mounted between the rails, contact wheels mounted on the spindles, the contact wheels being in a plane normal to the spindles, engaging means on the peripheries of the contact wheels and adapted to engage the frame means, the contact wheels being operative to modify the speed of the car in accordance with a selected rotational speed of the contact wheels.

In accordance with a further feature of the invention, there is provided a material handling car and track assembly in combination with a conveyor means which is disposed adjacent the track assembly. The conveyor means directs material to the cars on the track at a load station. The conveyor means is directed by a first sensing means which detects the approach of a car and starts rotational movement of a multiplicity of contact wheels to cause the car to travel through the load station at a selected speed at which the car receives the material from the conveyor means.

In accordance with a further feature of the invention, the material handling car and track assembly further comprises a merge management means and vehicle injection means for merging an additional car into the track assembly, the merge management means adapted to coordinate with the first sensing means to establish the location of the cars on the track assembly, the merge management means being further adapted to receive a signal from the vehicle injection means, the vehicle injecting means detecting the approach of an additional car at a merge location and signaling the merge management means to instruct the contact wheels to propel or brake the additional car at the merge location.

In accordance with a still further feature of the invention, the material handling car and track assembly further comprises a material injection means disposed along the conveyor means for delivering the material from the conveyor means to the car, the material injection means being adapted to receive instructions from a system management means to deliver the material to the car simultaneously with the arrival of the car at the load station.

The above and other features of the invention, including various novel details of construction and combinations of parts, will now be more particularly described with reference to the accompanying drawings and pointed out in the claims. It will be understood that the particular devices embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DETAILED DESCRIPTION OF THE PREFERRED EMBODIMENTS

Figure 1:
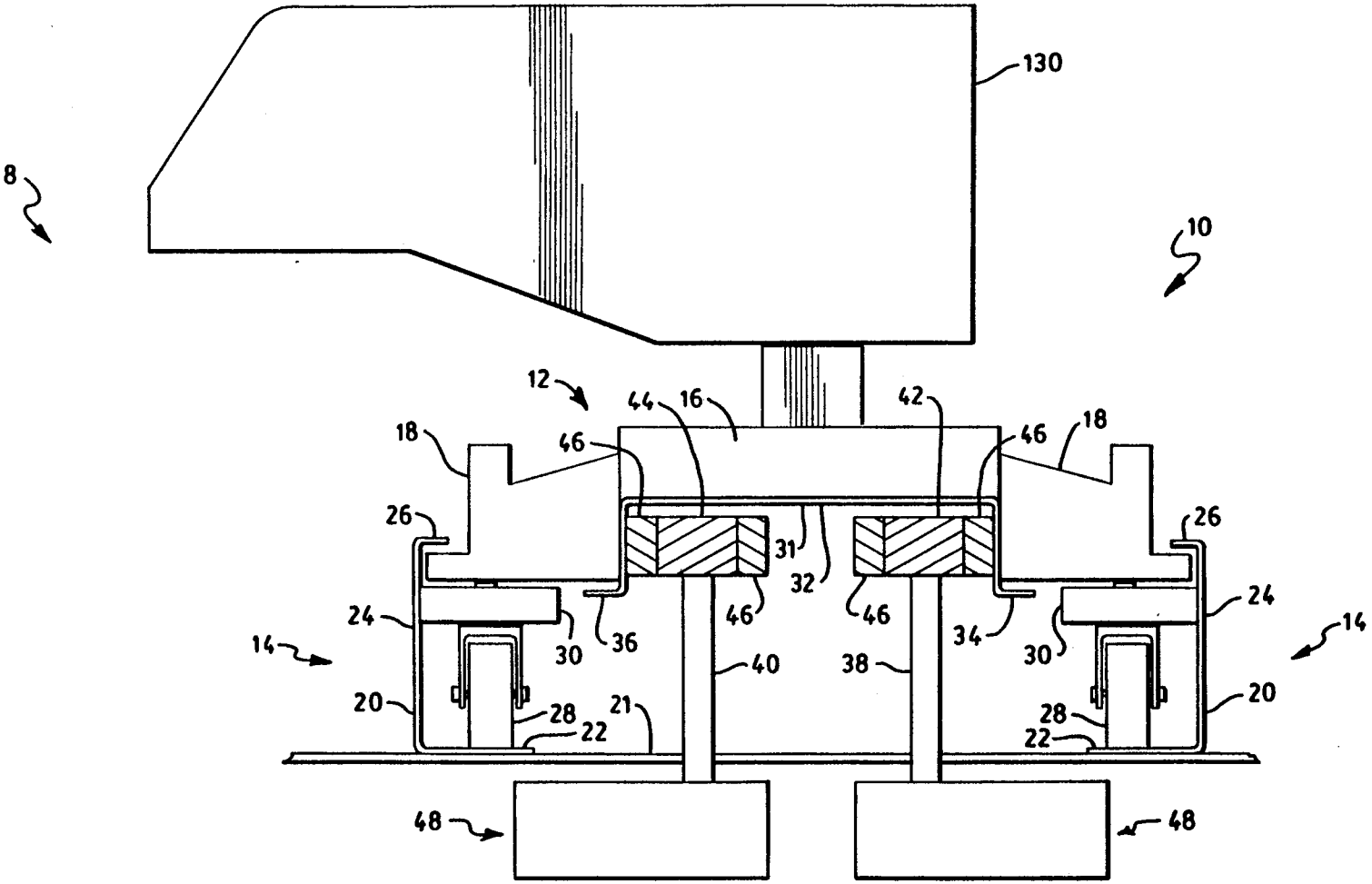
FIG. 1 is a front elevational view, partly in section, of a material handling car in combination with a track assembly.

Referring to the drawings, and particularly FIG. 1, there is shown a material handling car and track assembly 8 illustrative of the present invention. The assembly 8 comprises a material handling car 10 with a chassis portion 12 movable upon a track assembly 14. One preferred use of the car 10 is to transport material, such as baggage, from one location in an airport to another location. The chassis portion 12 has fixed thereto, at either end thereof, a bumper mount 16 with two caster mounts 18 attached to each of the bumper mounts at opposite ends thereof.

The track assembly 14, which is used in conjunction with the chassis portion 12, includes a pair of parallel opposed U-shaped rails 20 and a horizontal planar member 21, which serves as the bottom portion of the track assembly 14. Each of the rails 20 includes a horizontal bottom plate 22 extending inwardly from a bottom edge of a vertical side wall 24, and a horizontal top plate 26 extending inwardly from a top edge of the vertical side wall 24.

Travel wheels 28, 30 are mounted on the caster mounts 18 of the car 10. The travel wheels include vertically disposed wheels 28, rotating around a horizontal axis, and horizontally disposed wheels 30, rotating around a vertical axis. The vertical travel wheels 28 roll upon the upper surface of the bottom rail plates 22 of the rails 20. The horizontal travel wheels 30 roll along the neighboring side walls 24 of the rails 20. The horizontal travel wheels 30 operate to keep the car 10 centered upon the track. The travel wheels 28 and 30 are adapted to roll on the rails 20 to facilitate movement of the car 10 along the track.

Depending from the underside of the chassis portion 12 is a frame means 31. The frame means 31 consists of a horizontal planar member 32, to either end of which there is attached, as by welding, the bumper mount 16 of the chassis portion 12, and L-shaped first and second frame portions 34. 36 extending downwardly toward the surface of the track horizontal member 21. The frame means 31 extends lengthwise of the car 10.

The first and second frame portions 34, 36 are spaced apart from each other. Mounted in the track assembly 14, between the rails 20, and between the first and second frame portions 34, 36 are first and second spindles 38, 40. Contact wheels 42 and 44 are mounted on the spindles 38 and 40, respectively. The contact wheels 42, 44 are disposed in a plane normal to the spindles 38, 40, with the contact wheels 42, 44 disposed horizontally, each rotating around a vertical axis. As may be seen in FIG. 1, engaging means 46 is fixed to the periphery of each of the contact wheels 42, 44. In a preferred embodiment, the engaging means 46 comprises elastomeric bands.

Figure 2:
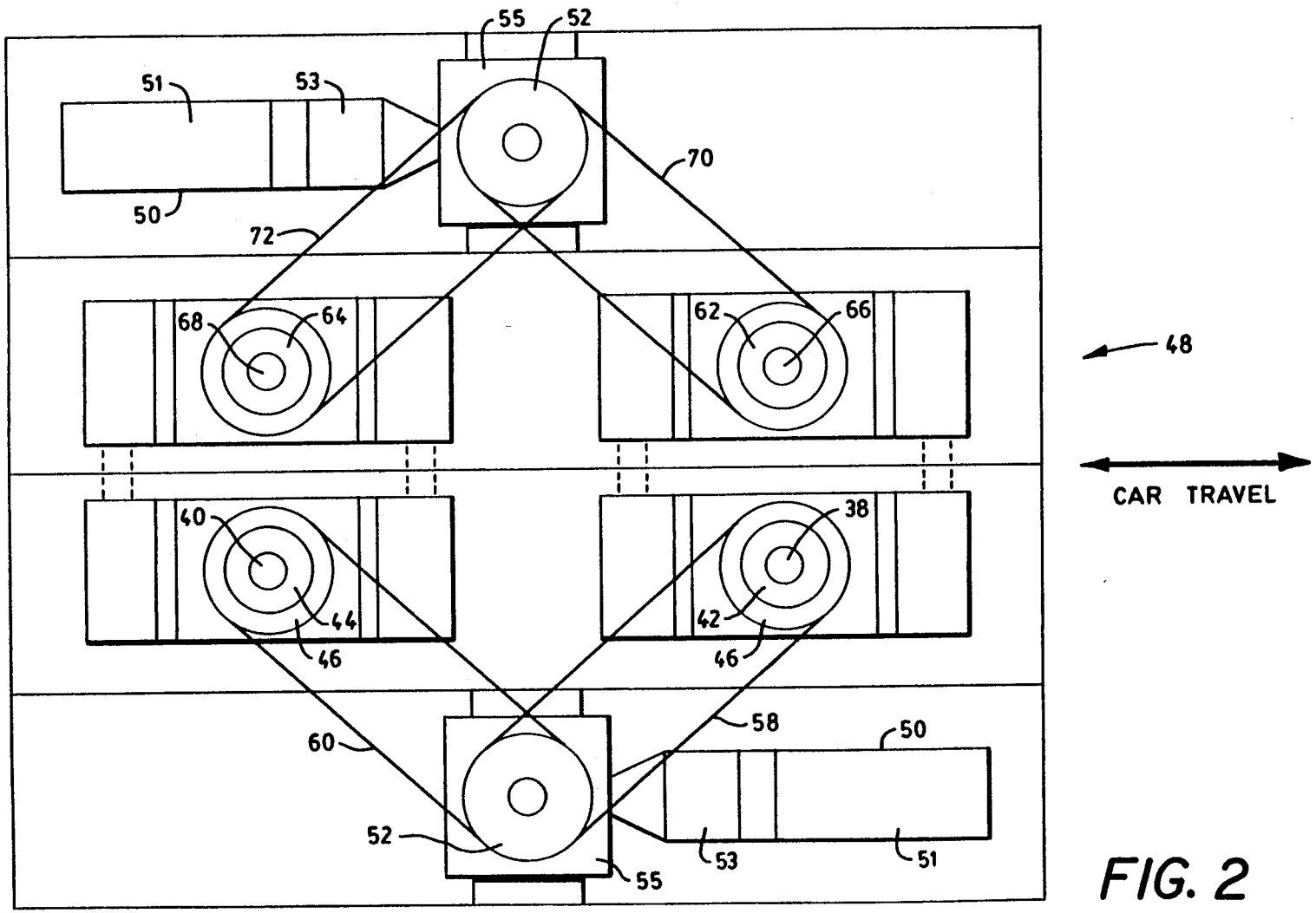
FIG. 2 is a top plan view of an actuating means, illustrating a feature of the present invention.

The contact wheels 42 and 44 engage the car 10 to modify the speed of the car 10 in accordance with an actuating means 48 (FIG. 2). In one embodiment, shown in FIG. 1, the contact wheels 42, 44 are disposed inboard of downwardly extending wall portions of first and second frame portions 34, 36. Each downwardly extending frame portion 34. 36 is engaged by one of the contact wheels 42, 44. Elastomeric bands, or other engaging means 46, which are placed on the peripheries of the contact wheels 42, 44, enable the contact wheels 42 and 44 to engage the frame means downwardly extending portions 34, 36. The elastomeric bands 46 are adapted to engage the frame portions rotationally when a car passes thereover. The contact wheels typically turn continuously, or when directed by a management means, engaging a car frame at a rotational speed dictated by the actuating means 48. Inasmuch as the engaging means 46 of the contact wheels 42, 44 are spaced from each other, there is no continuous wear imposed upon the engaging means. Contrary to prior art systems, the peripheries of the contact wheels 42, 44 will not be caused to wear down from constant rotation because the contact wheels do not engage each other, and engage the first and second downwardly extending frame portions 34, 36 only upon passage of a car thereover.

In an alternative embodiment (not shown), the contact wheels 42 and 44 are disposed outboard of the frame portions 34 and 36.

Figure 3:
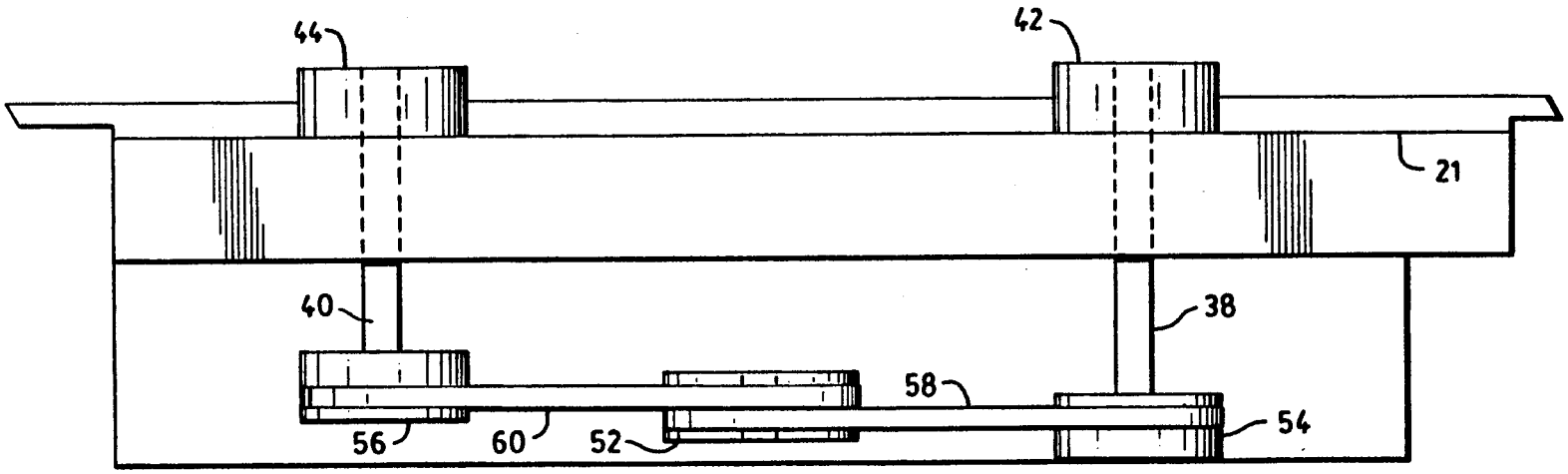
FIG. 3 is a sectional front view of the actuating means of FIG. 2.

The actuating means 48 comprises the means by which the contact wheels 42, 44 are operated to modify the speed of the car 10. Each of the contact wheels 42 and 44 is operated by separate units of the actuating means 48. As shown in FIG. 2, each of the actuating means 48 comprises an operating means 50 connected to a drive wheel 52. The drive wheel 52, shown in FIGS. 2 and 3, is rotatably connected to at least two satellite wheels 54, 56. The satellite wheel 54 is in rotary connection with the contact wheel 42. The satellite wheel 56 is in rotary connection with the contact wheel 44. In one embodiment, the operating means 50 is linearly connected to the drive wheel 52.

In a preferred embodiment, the operating means 50 comprises rotary motors 51. Each of the operating means 50 preferably includes the rotary motor 51, an electromechanical clutch brake 53, and a gear reducer 55. The gear reducer 55 is adapted to increase the torque of elastomeric belts 58 and 60 which connect the drive wheel 52 to the satellite wheels 54, 56, and slows the speed of the drive wheel 52. The electromechanical clutch brake 53 enables the engagement of the clutch in order to propel the contact wheels 42, 44, or alternatively, the disengagement of the clutch to stop the contact wheels 42, 44. The rotary motors 51 are regulated by a computer (not shown), which establishes a rotational speed at which the drive wheel 52 revolves. The computer serves as a system management means which regulates the rotary motors, or other operating means 50.

The drive wheel 52 is rotated by one of the rotary motors 51, driving through the clutch brake 53 and the reducer 55 (FIG. 2). The drive wheel 52 accommodates a continuous drive belt 58 which wraps around the outer periphery of the drive wheel 52 and the satellite wheel 54. The satellite wheel 54 is connected to the contact wheel 42 by the spindle 38. The drive belt 60 wraps around the outer periphery of the drive wheel 52 and the satellite wheel 56. The satellite wheel 56 is connected to the contact wheel 44 by the spindle 40. The drive belts 58 and 60 may be of an elastomeric material, enabling the drive wheel 52 to rotate the satellite wheels 54, 56, in order to modify the speed of the car 10.

The satellite wheels 54, 56 are disposed drivingly between the drive wheel 52 and the contact wheels 42, 44. Each of the satellite wheels 54, 56 accommodates the continuous drive belt 58, 60. The satellite wheels 54, 56 are adapted to drive the spindles 38, 40, (shown in FIG. 3) which rotate the contact wheels 42, 44. The contact wheels 42, 44 are mounted on top of the drive spindles 38, 40. In addition, the satellite wheels 54, 56 are placed apart from the drive wheel 52 in order to limit the expansion of the flexible elastomeric drive belts 58, 60, respectively, the expansion being caused by the drive belts 58, 60 being stretched over a period of time. In one embodiment, as shown in FIG. 3, the satellite wheels 54, 56 are disposed in a horizontal plane with the drive wheel 52. The drive wheel 52, and the satellite wheels 54, 56 are disposed below the horizontal planar member 21 of the track assembly 14.

The contact wheels 42, 44 are respectively driven by the drive spindles 38, 40 which are respectively controlled by the satellite wheels 54, 56 respectively rotated by the drive belts 58, 60. Neighboring contact wheels 62, 64 are respectively driven by drive spindles 66, 68 which are controlled by the satellite wheels rotated by drive belts 70, 72.

In one embodiment, shown in FIGS. 2 and 3, the drive wheels 52 are adapted to rotate the contact wheels 42, 44 in engagement with the first car chassis frame portion 34, and the contact wheels 62, 64 in engagement with the second car chassis frame portion 36. This provides a supplemental source of power to each car chassis 12, in order to ensure mobility of the cars.

Figure 4:
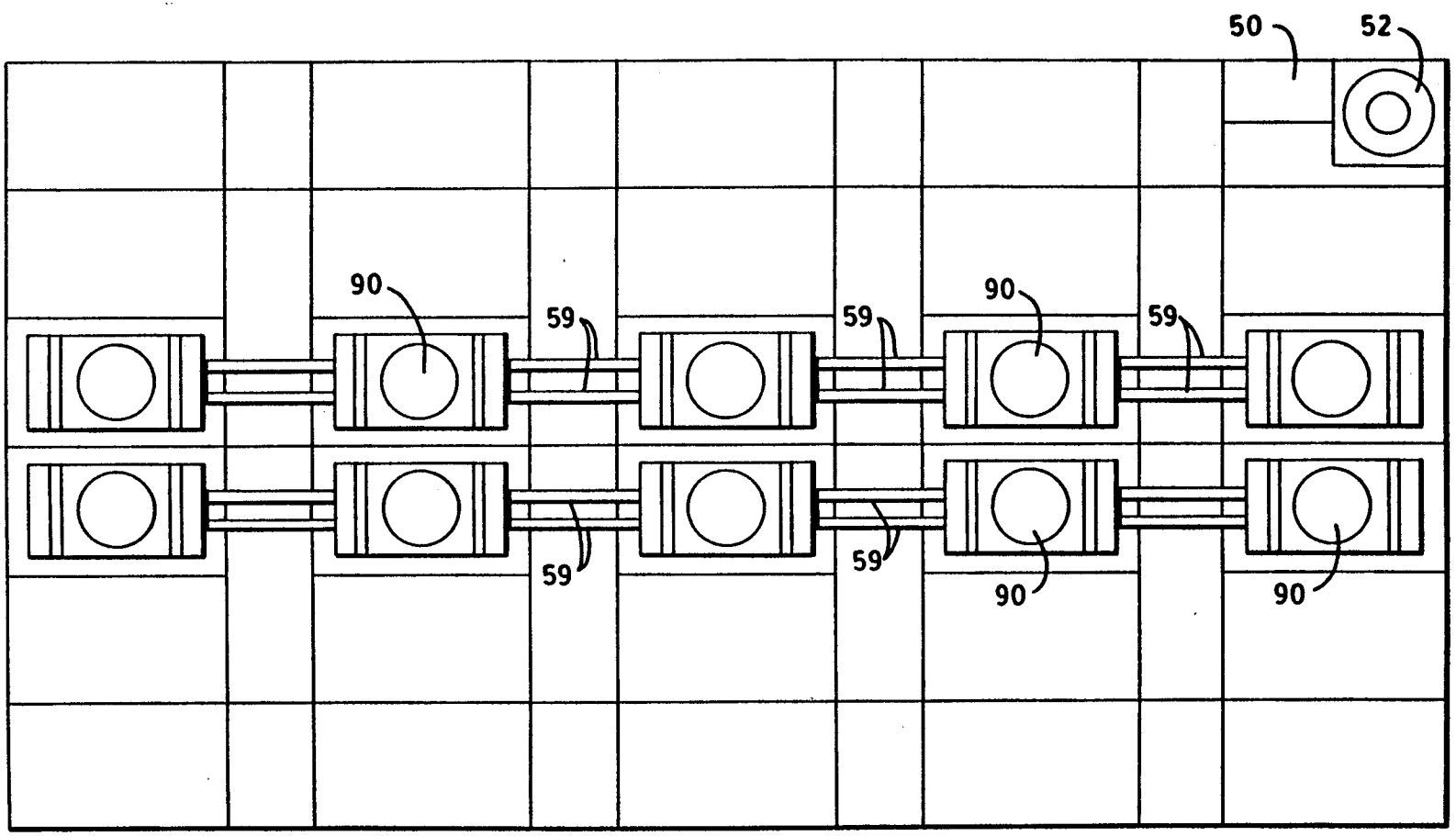
FIG. 4 is a top plan view of a portion of the track assembly in combination with the actuating means of FIGS. 2 and 3.

In further embodiments, each drive wheel 52 is adapted to operate a single satellite wheel, or, alternatively. adapted to operate more than two satellite wheels. As shown in FIG. 4, the drive wheel 52, operated by the operating means 50, is adapted to drive multiple contact wheels 90 interconnected by means of drive belts 59, the drive belts 59 rotating satellite wheels (not shown) which drive the spindles (not shown) upon which the contact wheels 90 are mounted. One particular area in which multiple contact wheels are necessary is where a track has sharp inclines. When a car is traversing up or down a sharp incline, it is particularly necessary for the car to maintain a precise speed. In the present invention, a single motor is capable of accomplishing this function.

In a further embodiment, one or more satellite wheels, such as, for example, satellite wheels 62, 64, may be non-powered and adapted only to resist the compression force of other of the contact wheels as, for example, the wheels 42, 44.

Figure 5:
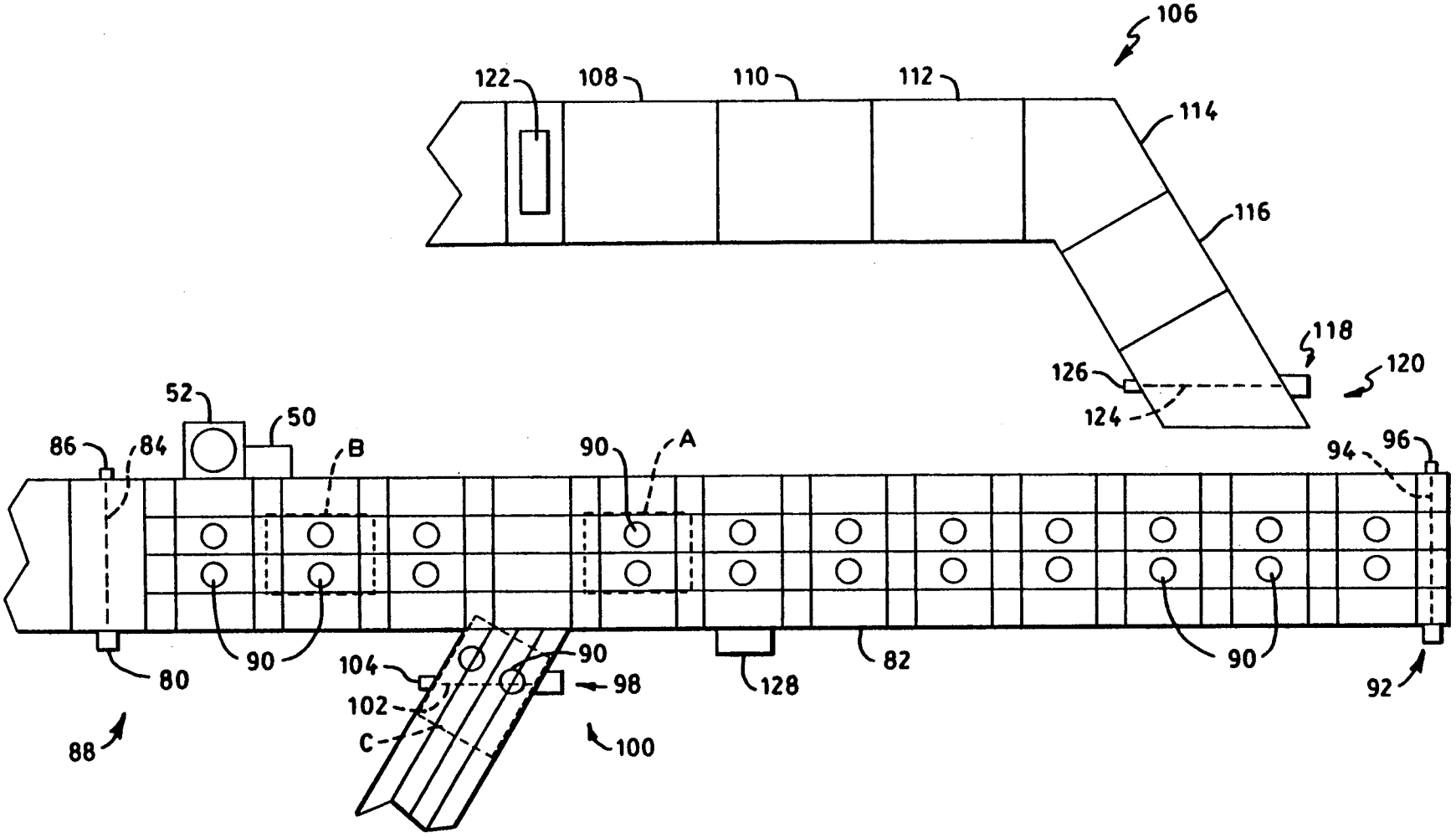
FIG. 5 is a top plan view of the track assembly, as illustrated in FIG. 4, in combination with a conveyor means and load station.

Referring to FIG. 5, a first sensing means 80 is shown on the side of a track assembly 82. The first sensing means 80 is adapted to detect the approach of a car 10 on the track assembly 82.

The first sensing means 80 may comprise a photocell. The photocell is adapted to emit a beam 84 (shown in phantom in FIG. 5) across the track assembly 82, the photocell beam being reflected by a reflector 86 on the opposite side of the track assembly 82 back to the photocell. When a car 10 (not shown) approaches the track assembly 82 at a track portion 88, where the photocell is located, the car 10 interrupts the beam 84 emitted by the photocell. The interruption of the beam 84 activates a computer (not shown) which commences the rotation of one or more of the drive wheels 52 (as shown in FIGS. 2 and 3) by means of the rotary motors 50, and establishes a constant rotational speed by which the drive wheels 52 rotate the satellite wheels which rotate the contact wheels 90. The drive wheel, or wheels, 52 are adapted to rotate a multiplicity of the contact wheels.

The rotational speed of the contact wheels 90 is fixedly established to be maintained at a constant selected determinate speed in the track assembly between the first sensing means 80 and a confirmation means 92.

The first sensing means 80 is further adapted to activate a merge management means (not shown). One of the functions of the merge management means is to enable cars to merge, at a merge location 100, between other cars traveling on the track assembly 82 between the first sensing means 80 and a load station 120. The merge location 100 is at a selected distance from the first sensing means 80. A track assembly may have numerous merge locations 100.

In one embodiment, the merge management means comprises a computer (not shown) which operates to calculate the time between two consecutive cars traveling past the first sensing means 80. Since the cars are traveling at a constant speed controlled by the contact wheels 90, the computer is able to calculate the distance between the two cars, based on the time between them. Each car is manufactured to be the same finite length.

Referring to FIG. 5, a vehicle injection means 98 will be seen at the merge location 100. The vehicle injection means 98 may comprise a photocell. The photocell is adapted to emit a beam 102 (shown in phantom) across the merge location 100, the photocell being reflected by a reflector 104 on the opposite side of the merge location 100 back to the photocell.

The interruption of the beam 102 transmits a signal to the merge management means, which indicates that a car C in the vehicle injection means 98 must be merged into the track assembly 82. The merge management means calculates the time t1 between car A (shown in phantom in FIG. 5). a car which has passed the first sensing means 80, and car B (shown in phantom), a subsequent car which has passed the first sensing means 80. The interruption of the beam 84 commences the contact wheels 90 to rotate at a constant speed between the first sensing means 80 and the confirmation means 92. The merge management means calculates the distance between the two cars A and B, based on the time between the cars and the velocity of the cars. The merge management means then calculates whether there is ample space, based on the length of each car, for car C (shown in phantom) to merge into the track assembly 82 between the cars A and B. If ample space has been provided between the two consecutive cars on the track assembly 82, then the contact wheels 90, disposed at the merge location 100, will accelerate the car C into the track assembly 82 from the vehicle injection means 98. In the alternative, if there is not sufficient space for the car C to enter the track assembly 82 at the vehicle injection means 98, the contact wheels 90 will brake, and the car C will remain immobilized. The contact wheels 90 will not accelerate the car C until there is sufficient room provided in the track assembly 82.

For example, in operation, the car A approaches the first sensing means 80 and interrupts the beam 84. The management means resets the timer to zero, and the contact wheels 90 begin to rotate at a selected speed which carries a car at a corresponding selected speed, as for example, 12 feet per second. The car A travels for 1.5 seconds before the car B interrupts the beam 84. Therefore, the car A has traveled a distance of 18 feet from the first sensing means 80. The car C has approached the vehicle injection means 98 and interrupted the beam 102 which activates the merge management means. The merge management means then instantaneously calculates whether sufficient space is provided for the car C to merge into the track assembly 82. The merge management means has already been given the information that the merge location 100 is 30 feet from the first sensing means 80, that each car is 6 feet long, and that it takes a car one second (12 feet) to accelerate into the track assembly 82 from the merge location 100. The merge management means then calculates that if there is 18 feet between cars A and B, then in one second, when the car C reaches the merge location 100, there is ample space for the car C to merge into the track assembly 82. Therefore, the contact wheels 90 accelerate the car C one second after the car B has interrupted the beam 84, and continues to accelerate for one second to merge the car C between the cars A and B in the track assembly 82.

If, on the other hand, there is less than 18 feet between the cars A and B, the contact wheels 90 brake and the car C remains immobilized until the merge management means calculates at least 18 feet between two consecutive cars. Alternatively, if there is more than 18 feet between the cars A and B, or if no car interrupts the beam 84 after the car A, and the car C reaches the vehicle injection means 98, and the merge management means has already timed more than 1.5 seconds, the contact wheels 90 accelerate the car C and merge the car C into the track assembly 82, behind the car A.

Referring to FIG. 5, it will be seen that a conveyor means 106 is disposed adjacent the track assembly 82. The conveyor means 106 includes a series of individual conveyors 108, 110, 112, 114, and 116. In other embodiments, there may be different numbers of individual conveyors. The individual conveyors 108, 110, 112, 114, and 116 are adapted to transport material to an injection means 118 at the load station 120 disposed in the stream of the conveyor means. The load station 120 is located a fixed distance from the first sensing means 80.

A material identifying means 122 is disposed upstream of the individual conveyors on the conveyor means. The material identifying means is adapted to identify an array printed on the material, such as baggage or packages. For example, for use of this assembly in an airport, the array will identify the owner and destination of a bag. The information is then stored in the system management means. The material identifying means 122 confirms the presence of material approaching the material injection means.

In one embodiment, the material identifying means 122 comprises a laser which reads a particular printed code on a bag, or the like. The laser then sends the information to the system management means.

As the materials travel past the identifying means 122, the conveyor means automatically advances each material toward the load station 120. As the first material advances toward the load station 120, it is stopped by the injection means 118. In one embodiment, the injection means comprises a photocell. The photocell is adapted to emit a beam, 124, across the load station 120, the photocell beam being reflected by a reflector 126 on the opposite side of the load station 120, back to the photocell. While the beam 124 of the photocell is interrupted, the first material on the injection means 118 remains halted. As the next material advances toward the load station 120, it stops on the next individual conveyor 116 upstream of the load station. Similarly, as each material is identified, it will be advanced toward the load station 120 until each of the individual conveyors 108, 110, 112, 114, and 116 disposed on the conveyor means is full.

Referring to FIG. 5, vehicle identifying means 128 is shown disposed along the side of the track assembly 82, between the vehicle injection means 98 and the portion of the track assembly 82 directly opposite the load station 120. The vehicle identifying means 128 is adapted to identify the serial number of the passing car to the system management means. This number will be the number which the management means thereafter associates with the particular car. Additionally, the vehicle identifying means 128 confirms the presence of a car approaching the load station 120.

In one embodiment, the vehicle identifying means 128 comprises a radio frequency transponder. The radio frequency transponder responds to an interrogation by an antenna, and identifies the serial number to the system management means. Vehicle identifying means 128 are located throughout the track system. For example, if this assembly were located in an airport, the vehicle identifying means would be dispersed throughout the airport leading from and to the numerous gates and terminals. The identification of the car enables an operator to locate the car at any point in time at any location in the airport.

Since the load station 120 is located a fixed distance from the first sensing means 80, as the car A travels at a constant speed after it passes the first sensing means 80, the system management means recognizes the time required for the car A to approach the material injection means 118 at the load station 120. When the center of the car A is disposed immediately opposite the center of the bag, or other material, disposed on the injection means 118, the system management means commences the conveyor means 106 and causes the bag to be dropped from the load station 120 onto a tray 130 (shown in FIG. 1) disposed on the chassis 12. The identification of the particular bag thereafter remains associated with the serial number of the particular car. The bag remains on the tray 130 of the chassis 12 of the car A throughout the track until it is later unloaded at another destination. An operator of the system management means, therefore, is able to locate any bag at any time by finding the location of the car A which, as previously discussed, passes numerous vehicle identifying means 128 throughout its passage.

When the bag is removed from the bag injection means 118, the beam 124 is uninterrupted. The uninterrupted beam 124 causes two reactions. First, the uninterrupted beam 124 confirms to the system management means that the bag was transferred from the bag injection means 118 to the car A. Secondly, the uninterrupted beam 124 causes the system management means to start the conveyor means 106 to move the next bag which was disposed on the adjacent upstream conveyor 116 downstream to the beam 124 of the bag injection means 118. When the bag reaches the beam 124, the interrupted beam 124 stops the bag. The remaining bags each move down one conveyor toward the load station 120.

As the car A exits the load station, it passes the confirmation means 92. The confirmation means 92 is adapted to confirm to the system management means that the car A carrying the material did, in fact, leave the load station 120. The confirmation means 92 may be a photocell. The photocell is adapted to emit a beam, 94, across the track assembly 82, the photocell beam being reflected by a reflector 96 on the opposite side of the track assembly 82 back to the photocell. Once the car A has passed the confirmation means, both the bag and the car remain identifiable at any point on the track assembly 82.

The synchronization between the car A propelling forward on the track assembly 82 and material unloading from the load station 120 is one of the advantages of the present invention. Similarly, the car will unload the piece of baggage by means of the tray 130 further downstream on the track assembly 82 the same way as embodied herein. Both of these functions provide for efficient, rapid, and dependable baggage dispersal, while requiring a limited number of people to operate the dual assemblies.

It is to be understood that the present invention is by no means limited to the particular construction herein disclosed and/or shown in the drawings, but also comprises any modifications or equivalents within the scope of the claims. For example, while the transport of bags has often been used in the above description for illustrative purposes, the system is equally well adapted to handle other materials, such as mail, cargo, packages, bulk load items, and other similar articles and materials.

Having thus described our invention, what we claim as new and desire to secure by Letter Patent of the United States is:

1. A material handling car and track assembly, said assembly comprising:

a car having a chassis portion, a track having two parallel rails, travel wheels mounted on said chassis portion for rolling on said rails, frame means depending from an underside of said chassis portion, said frame means comprising first and second frame portions spaced from each other, said frame portions having vertical walls with inboard surfaces thereon, said frame members extending lengthwise of said car, first and second spindles mounted between said rails, contact wheels mounted on said spindles, said contact wheels being in a plane normal to said spindles, engaging means on the peripheries of said contact wheels for engaging said inboard surfaces of said frame means, said first and second spindles being disposed between said vertical walls when said contact wheels engage said vertical walls, and actuating means for driving said contact wheels at selected rotational speed, whereby upon engagement of said contact wheels with said frame portions, said contact wheels are operative to modify the speed of said car in accordance with said selected rotational speed of said actuating means.

2. The material handling car and track assembly in accordance with claim 1 wherein said first and second spindles extend upwardly from between said rails.

3. The material handling car and track assembly in accordance with claim 1 wherein said engaging means comprises elastomeric bands.

4. The material handling car and track assembly in accordance with claim 1 wherein said frame portions are disposed outboard of said contact wheels.

5. The material handling car and track assembly in accordance with claim 1 wherein said actuating means comprises (i) an operating means regulated by a computer, (ii) drive wheel means rotatably driven by said operating means, and (iii) satellite wheel means driven by said drive wheel means by a drive belt means, said contact wheels being connected to said satellite wheel means by said spindles.

6. The material handling car and track assembly in accordance with claim 5 wherein said operating means comprises a rotary motor.

7. The material handling car and track assembly in accordance with claim 5 wherein said drive wheel means and said satellite wheel means are mounted beneath said rails of said track assembly.

8. The material handling car and track assembly in accordance with claim 5 wherein said drive belt means is comprised of elastomeric material.

9. The material handling car and track assembly in accordance with claim 5 wherein a drive wheel of said drive wheel means is in rotary connection with a plurality of satellite wheels of said satellite wheel means.

10. A material handling car and track assembly, said assembly comprising cars adapted to travel on a track, said cars having chassis portions and tray portions mounted on said chassis portions, said tray portions being adapted to receive, carry and discharge material, travel wheels mounted on said chassis portions to facilitate said travel of said cars on said track, said chassis portions having frame means extending downwardly therefrom, contact wheels mounted on said track assembly and disposed between vertical walls of said frame means when said contact wheels engage said vertical walls and disposed normal to said frame means, said contact wheels having elastomeric peripheries adapted to engage said downwardly extending frame means to modify the speed of travel of said cars in accordance with a selected rotational speed of an actuating means, conveyer means disposed adjacent said track for directing material to said cars on said track at a load station, said contact wheels being disposed in said track in the approach to said load station and in said load station, and first sensing means for detecting the approach of one of said cars, said first sensing means being operative to start rotational movement of a plurality of said contact wheels to cause said car to travel through said load station at a selected speed at which said car receives said material from said conveyer means.

11. The material handling car and track assembly in accordance with claim 10 wherein said assembly includes said actuating means which comprises (i) an operating means regulated by a computer, (ii) a drive wheel driven by said operating means, said operating means establishing a speed at which said drive wheel rotates, and (ii) satellite wheels, each of said satellite wheels being in rotary connection with said drive wheel by means of a drive belt, each of said contact wheels being fixedly connected to one of said satellite wheels.

12. The material handling car and track assembly in accordance with claim 11 wherein said operating means comprises a rotary motor.

13. The material handling car and track assembly in accordance with claim 11 wherein said drive wheel and said satellite wheels are mounted beneath said rails of said track assembly.

14. The material handling car and track assembly in accordance with claim 11 wherein said drive belt is comprised of elastomeric material.

15. The material handling car and track assembly in accordance with claim 11 wherein said drive wheel is in rotary connection with a plurality of said satellite wheels.

16. The material handling car and track assembly in accordance with claim 10 wherein said conveyer means includes a series of individual conveyors, said individual conveyors each adapted to transport said material.

17. The material handling car and track assembly in accordance with claim 10 wherein said first sensing means is located a predetermined distance from said load station.

18. The material handling car and track assembly in accordance with claim 10 wherein said first sensing means comprises a photocell disposed on a side of said track assembly.

19. The material handling car and track assembly in accordance with claim 18, wherein said photocell emits a beam across a portion of said track assembly, said photocell beam being reflected by a reflector on the opposite side of said track assembly portion back to said photocell, said photocell being interrupted by an approaching one of said cars.

20. The material handling car and track assembly in accordance with claim 10 wherein said assembly further comprises a vehicle injection means for merging an additional car into said track assembly, said first sensing means establishing the location of said cars on said track assembly, and signaling a merge management means as to said location, said vehicle injecting means detecting the approach of said additional car at a merge location and signaling said merge management means to coordinate said car location received from said first sensing means with said approach of said additional car and to instruct said contact wheels to propel or brake said additional car at said merge location.

21. The material handling car and track assembly in accordance with claim 20 wherein said vehicle injection means includes a photocell.

22. The material handling car and track assembly in accordance with claim 20 wherein said merge management means comprises a computer.

23. The material handling car and track assembly in accordance with claim 20 wherein said assembly further comprises a material injection means disposed along said conveyor means for delivering said material from said conveyor means to said car.

said material injection means receiving instructions from a system management means to deliver said material to said car simultaneously with the arrival of said car at said load station.

24. The material handling car and track assembly in accordance with claim 23 wherein said material injection means further confirms the delivering of said material to said car.

25. The material handling car and track assembly in accordance with claim 23 wherein said material injection means includes a photocell.

26. The material handling car and track assembly in accordance with claim 23 wherein said assembly further comprises a confirmation means disposed on said track assembly downstream of said load station, said confirmation means corroborating the departure of said car with said material from said load station.

27. The material handling car and track assembly in accordance with claim 26 wherein said confirmation means comprises a photocell.

28. The material handling car and track assembly in accordance with claim 23 further comprising a vehicle identifying means disposed on said track assembly for establishing the location and identity of said car, said vehicle identifying means further confirming the presence of said car on said track assembly.

29. The material handling car and track assembly in accordance with claim 28 wherein said vehicle identifying means is disposed on said assembly between said vehicle injection means and said load station.

30. The material handling car and track assembly in accordance with claim 23 further comprising a material identifying means disposed on said conveyer means for establishing the identity and location of each individual material, said material identifying means further confirming the presence of said material approaching said bag injection means.

* * * * *